United States Patent [19]

Streich et al.

[11] Patent Number: 4,988,964

[45] Date of Patent: Jan. 29, 1991

[54] ELECTROMAGNETIC SWITCHGEAR

[75] Inventors: Georg Streich, Amberg; Günter Gnahn, Sulzbach-Rosenberg; Kurt Held, Amberg, all of Fed. Rep. of Germany

[73] Assignee: Siemens Aktiengesellschaft, Berlin & Munich, Fed. Rep. of Germany

[21] Appl. No.: 403,689

[22] Filed: Sep. 5, 1989

[30] Foreign Application Priority Data

Sep. 5, 1988 [DE] Fed. Rep. of Germany ..... 8811206

[51] Int. Cl.[5] ..... H01H 67/02

[52] U.S. Cl. ..... 335/131; 335/274

[58] Field of Search ..... 335/274, 131–132, 335/277, 257

[56] References Cited

U.S. PATENT DOCUMENTS 3,409,851 11/1968 Scheib, Jr. et al. ..... 335/126

4,378,542 3/1983 Feil ..... 335/126

4,521,758 6/1985 Krubsack ..... 335/126

*Primary Examiner*—Leo P. Picard

*Assistant Examiner*—Lincoln Donovan

*Attorney, Agent, or Firm*—Kenyon & Kenyon

[57] ABSTRACT

In an electromagnetic switchgear with movable contact parts held in a movable contact support and forming, with fixed contact parts, opening and closing contacts, the contact support being elastically connected with the armature in such a way that, with the opening contact welded, an onward movement of the movable magnet part is possible without operation of the closing contact, the yoke of the magnet system is also suspended elastically in its closing direction and this elastic suspension, the elastic connection between the armature and contact support and the elasticity of the movable contact parts are matched to one another in such a way that with the opening contact welded and the magnet system closed, the spring excursions of the armature and yoke are approximately the same.

6 Claims, 1 Drawing Sheet

OFF

ON normal

ON welded

ELECTROMAGNETIC SWITCHGEAR

BACKGROUND OF THE INVENTION

This invention relates to an electromagnetic switchgear in general and more particularly to such switchgear which provides for closing of the magnet when break contacts are welded.

Electromagnetic switchgear with movable contact parts held in a movable contact support and forming, with fixed contact parts, opening and closing contacts is known, for example, from U.S. Pat. No. 4,737,749. In the disclosed switchgear the contact support is elastically connected with the armature in such a way that, if the opening contacts become welded together, an onward movement of the movable magnet part is possible without actuation of the closing contacts. Upon the welding of opening contacts the closing contacts are thus prevented from closing. In such a case to cause the magnet system to close, i.e., to be magnetically closed, in order to prevent the coil from blowing, a relatively large spring excursion of the coupling spring between the contact bridge support and the armature is required. This has an adverse effect on the size of the switchgear. Thus, there is a need for a switchgear of the above-mentioned kind which is easy to construct while being compact.

SUMMARY OF THE INVENTION

This need is fulfilled in a simple manner by the present invention. To do this, the yoke of the magnet system is also suspended elastically in its closing direction, and this elastic suspension, the elastic connection between armature and contact support and the elasticity of the movable contact parts are matched to one another in such a way that, with the opening contact welded and the magnet system closed, the spring excursions of armature and yoke are approximately the same. Since the connection between armature and contact support generally occurs through a bolt or pin, an implementation according to the present invention is possible without major construction costs if a leaf spring is provided as the elastic connection between armature and contact bridge support. The leaf spring may have a relatively soft characteristic. A simple matching of the parts with one another can be obtained if the elastic suspension of the yoke occurs through helical compression springs bracing against a latch traversing the yoke. To be able to utilize designs customary for the suspension of the yoke, it is advantageous if the helical compression springs act against the coil form at their ends away from the latch, which in turn braces against the switchgear housing.

DETAILED DESCRIPTION

Figure 1:
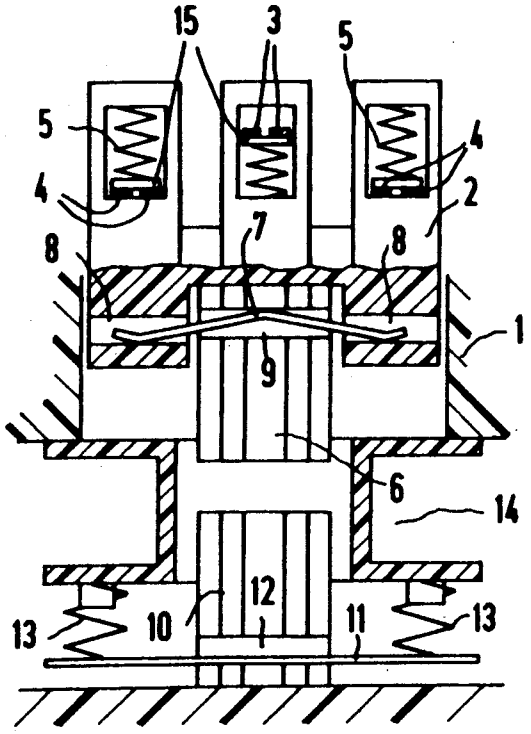
FIG. 1 is a basic diagram of the switchgear of the present invention in a sectional side view, in the OFF position.

The electromagnetic switchgear illustrated in FIG. 1 includes a housing 1, in which a contact support 2, is displaceably guided. Movable contact parts 3, with fixed contacts, forming the opening contacts, are designed as contact bridges 3. Further movable contact bridges 4 form closing contacts. The contact bridges 3 and 4 have spring collars 15 acting against them. Contact compression springs 5 bias the spring collars 15 and thus the contact bridges 3 and 4. An armature 6 is elastically connected to contact support 2 through a leaf spring 7. The leaf spring 7 is guided, on the one hand, in slots 8 of the contact support and, on the other hand, in an opening 9 in the armature 6. The leaf spring is of arched design so that a relative movement between contact support 2 and armature 6 is possible. A yoke !0 of the magnet system is traversed by a latch 11 extending through an opening 12, against which one of the ends of a plurality of helical compression springs 13 is braced. The yoke 10 is pressured against the housing bottom of the switch by springs 13 via latch 11. The other ends of springs 13 act against a coil form 14 which, as is evident from the drawing, abuts housing 1. In a manner similar to that disclosed in U.S. Pat. No. 4,737,749, the contact support 2 is biased in an upward direction by the contact compression springs 5 for the contact bridges 4 and by return springs (not shown in detail).

Figure 2:
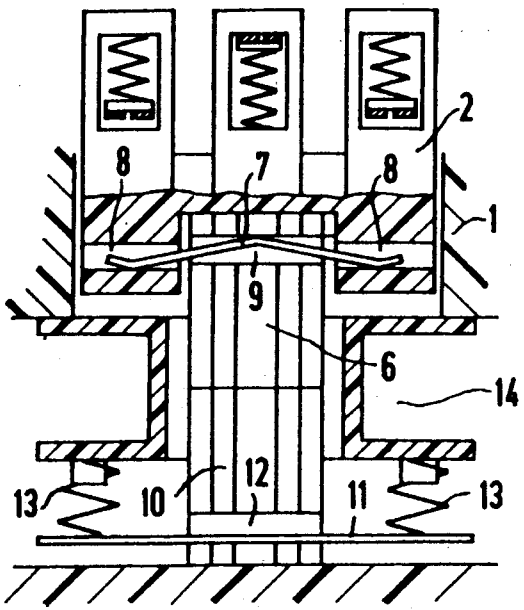
FIG. 2 illustrates the switchgear of FIG. 1 in the normal ON position.

Now when a voltage is applied to the coil of the magnet system, armature 6 moves from the position shown in FIG. 1 into the position shown in FIG. 2; the contact bridges 4 are separated from the fixed contact parts, not shown in detail, and the contact bridge 3 makes connection with additional fixed contact parts to form closing contacts. The springs 5 of the contact bridges 4 relax and the springs 5 of the contact bridges 3 are compressed.

Figure 3:
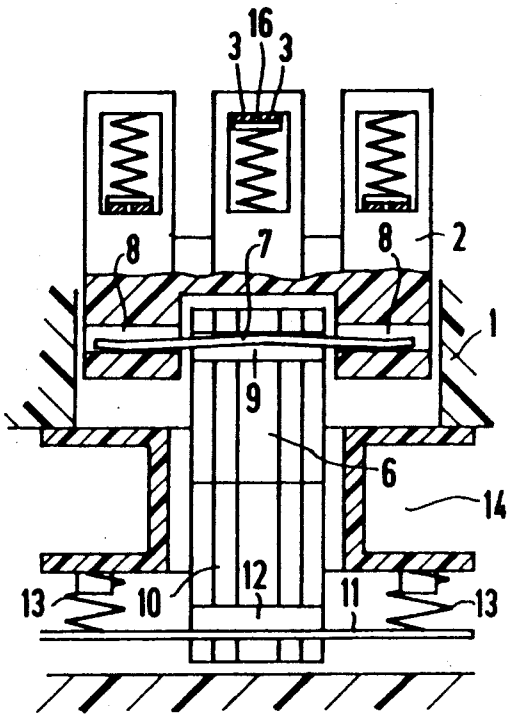
FIG. 3 shows the switchgear of FIG. 1 in the ON position with opening contacts welded.

However, if at least one of the contact bridges 3 is welded to the fixed contact parts, not illustrated in detail, the contact support 2 moves into the position shown in FIG. 3. Here, in fact, the contact bridge 3 comes into engagement with the edge 16 of the window in the contact support 2, so that onward movement of the contact support is prevented. In this state, the leaf spring 7 is flexed. For the closing of the magnet system the yoke 10 additionally moves counter to the force of the springs 13 in the direction toward the armature 6, so that—as FIG. 3 shows—the magnet system closes, i.e., the magnetic path is closed by abutment of armature 6 with yoke 10.

What is claimed is:

1. In electromagnetic switchgear comprising:

a housing;

a first magnet part including a yoke;

fixed contact parts;

a contact support movable in said housing;

movable contact parts held in said support and forming, with said fixed contact parts, opening and closing contacts;

a second magnet part including a movable armature;

means elastically connecting said contact support with said armature in such a way that with the opening contacts welded, an onward movement of the movable magnet part is possible without actuation of the closing contacts, the improvement comprising:

means suspending the yoke elastically in its closing direction, with said elastic suspension, the elastic connection between said armature and said contact support and the elasticity of the movable contact parts matched to one another in such a way that, with the opening contact welded and the magnet system closed, the spring excursions of said armature and said yoke are approximately the same.

2. The improvement according to claim 1, wherein said means elastically connecting said armature and said contact bridge support comprises a leaf spring.

3. The improvement according to claim 2, wherein said means suspending said yoke comprise helical compression springs and a latch traversing the yoke, against which said springs are braced.

4. The improvement according to claim 3, wherein said fixed magnet part further includes a coil form and wherein the ends of said helical compression springs away from said latch act against said coil form, said coil form, in turn, being braced against housing.

5. The improvement according to claim 1, wherein said means suspending said yoke comprise helical compression springs and a latch traversing the yoke, against which said springs are braced.

6. The improvement according to claim 5, wherein said fixed magnet part further includes a coil form and wherein the ends of said helical compression springs away from said latch act against said coil form, said coil form, in turn, being braced against housing.

* * * * *